US006618996B1

(12) United States Patent
Szyjkowski

(10) Patent No.: US 6,618,996 B1
(45) Date of Patent: Sep. 16, 2003

(54) ACCESS PANEL WITH SLIDING CLIP MEMBER

(75) Inventor: Jerzy Marek Szyjkowski, Caledon (CA)

(73) Assignee: Novera Products, Inc. (CA)

( * ) Notice: Subject to any disclaimer, the term of this patent is extended or adjusted under 35 U.S.C. 154(b) by 0 days.

(21) Appl. No.: 10/043,031

(22) Filed: Jan. 9, 2002

Related U.S. Application Data

(60) Provisional application No. 60/268,681, filed on Feb. 15, 2001.

(51) Int. Cl.[7] ..... E05C 21/02
(52) U.S. Cl. ..... 49/465; 292/175
(58) Field of Search ..... 49/463, 465; 292/8, 292/42, 175

(56) References Cited

U.S. PATENT DOCUMENTS

| | | | | | |
|---|---|---|---|---|---|
| 966,195 | A | * | 8/1910 | Golden | 49/465 |
| 1,693,190 | A | * | 11/1928 | Benedetti | 49/465 |
| 2,009,132 | A | * | 7/1935 | Gehris | 49/465 |
| 2,156,110 | A | | 4/1939 | Brukner | |
| 3,286,405 | A | | 11/1966 | Schembri | |
| 3,383,811 | A | | 5/1968 | Ades | |
| 3,491,486 | A | | 1/1970 | Caruth | |
| 4,113,303 | A | | 9/1978 | Yench | |
| 4,890,418 | A | | 1/1990 | Sachs | |
| 4,970,836 | A | | 11/1990 | Brown | |
| 5,255,479 | A | * | 10/1993 | Shepherd | 49/465 |
| 5,361,541 | A | | 11/1994 | Szyjkowski | |
| 5,551,191 | A | | 9/1996 | Maiwandi | |
| 5,765,312 | A | | 6/1998 | Szyjkowski | |
| 6,363,670 | B1 | * | 4/2002 | Dewitt | 49/465 |

* cited by examiner

*Primary Examiner*—Jerry Redman
(74) *Attorney, Agent, or Firm*—Young & Basile P.C.

(57) ABSTRACT

An access panel for covering an aperture in a structure such as a wall includes a planar panel member having inner and outer sides and a mounting member attached to the panel member adjacent a first edge thereof The mounting member extends rearwardly from the inner side of the panel and is arranged to engage the structure. A movable clip member is mounted on the panel member and extends rearwardly from the inner side and this member is linearly movable in a direction parallel to the panel from a first position spaced from an edge of the panel to a second position closer to this edge. A spring biases the clip member towards the second position and yieldably holds the clip member in this position. Preferably the panel has a guide track formed therein and the clip member is mounted for sliding movement along this track.

19 Claims, 4 Drawing Sheets

ACCESS PANEL WITH SLIDING CLIP MEMBER

PRIOR APPLICATION

This application claims domestic priority on the basis of U.S. provisional patent application No. 60/268,681 filed Feb. 15, 2001.

BACKGROUND OF THE INVENTION

This invention relates to access panels and doors which can be used to cover openings in walls and ceilings and to provide ready access to an enclosed space or installation through the opening.

It is well known in the building industry to provide an access door or panel which can include a door or panel frame and a hinged panel member on which a locking device can be mounted. The locking device may take the form of a latch such as a hook that is connectable to an eye member, a pivoting bar or a sliding bar. A frame can be mounted on the wall or in the ceiling and on this frame can be mounted the movable panel or door or, in the alternative, the access panel can be mounted directly to wall paneling or ceiling panels in a manner so as to cover the opening formed therein. These known access doors and panels generally require a certain size and shape for the opening formed in the wall or ceiling in order to ensure that the access panel can be properly installed.

As indicated so called "frameless" access panels are known and are designed to grip the inside surface of a wall or ceiling paneling which limits their possible use. Access panels of this type can generally not be used to cover an opening in a brick or concrete wall, for example.

My U.S. Pat. No. 5,765,212 issued Jun. 16, 1998 describes and illustrates an access panel that incorporates a frame clamping device. This panel is in the form of a plate having opposite side edges and a positioning frame extending rearwardly from the rear surface. The panel has two elongate clamping elements, each extending towards a respective one of the side edges from a central region of the plate. Each clamping element is made of a resilient spring material so that its outer end can be pulled away from the plate during installation.

Earlier U.S. Pat. No. 5,361,541 issued Nov. 8, 1994 and assigned to Superflex, Inc. describes a movable access door or panel that has two pivoting clips for removably attaching the panel to a structure. Each clip or clamping member is pivotally mounted adjacent a side edge of the panel. A spring biases the clips to swing them to a position whereby they releasably clamp edge sections of the structure.

It is an object of the present invention to provide an improved access panel for covering an aperture in a structure, such as a building wall, this access panel being relatively inexpensive to construct and capable of fitting apertures of varying size.

It is a further object of the present invention to provide an access panel capable of reliably covering an aperture in a structure, this panel including a panel member with a movable clip member mounted thereon and extending rearwardly from an inner side of the panel member. The clip member is linearly movable in a direction parallel to the panel member and is biased by means of a spring.

SUMMARY OF THE INVENTION

According to one aspect of the invention, an access panel for covering an aperture in a structure, such as a building wall or ceiling, includes a substantially planar panel member having inner and outer sides and a sufficient size to cover the aperture. A mounting member has an inner edge rigidly attached to the panel member adjacent a first edge thereof and extends rearwardly from the inner side of the panel member. This mounting member is arranged to engage the structure within the aperture during use of the access panel. A movable clip member is mounted on the panel member and extends rearwardly from the inner side of the panel member. This clip member is linearly movable in a direction parallel to the panel member from a first position spaced from the second edge of the panel member, which is opposite the first edge, to a second position closer to the second edge. This clip member is adapted to engage the structure within the aperture during use of the access panel. A spring mechanism biases the clip member towards the second position and yieldably holds the clip member in the second position when the access panel is mounted on the structure and covers the aperture. When the access panel is mounted on the structure so as to cover the aperture, the access panel can be removed from the aperture by pulling the panel member in a direction away from the aperture and thereby causing the clip member to move inwardly towards its first position against the biasing force of the spring mechanism.

The preferred panel member has a guide track formed therein and open on the inner side. The clip member is mounted for sliding movement along this guide track.

According to another aspect of the invention, an access panel for covering an aperture in a structure, such as a building wall, includes a panel member having inner and outer sides, a peripheral edge extending around its perimeter, and a guide track provided on the inner side. A mounting member has an inner edge rigidly attached to the panel member and projects rearwardly from the inner side of the panel member so as to engage the structure within the aperture during use of the access panel. A clip member is slidably mounted on the panel member and is guided in its movements by the guide track. The clip member is slidable in a direction parallel to the inner side of the panel member from a first position spaced from a portion of said peripheral edge to second position closer to said portion of the peripheral edge. The clip member is adapted to engage the structure within the aperture during use of the access panel. A spring mechanism is provided to bias the clip member towards the second position and to yieldably hold the clip member in this second position. When the access panel is mounted on the structure so as to cover the aperture, the access panel can be removed from the aperture by pulling the panel member in a direction away from the aperture and thereby causing the clip member to move inwardly towards its first position against the biasing force of the spring mechanism.

In one preferred embodiment the mounting member is an elongate flange rigidly attached to the panel member on the inner side and spaced from an adjacent portion of the peripheral edge.

According to a further embodiment of the invention, an access panel for covering an aperture in a structure, such as a building wall or ceiling, includes a panel member having inner and outer sides and dimensioned so as to at least substantially cover the aperture during use thereof. This panel includes two movable clip members mounted on the panel member and projecting rearwardly from its inner side. These clip members are linearly moveable in a direction parallel to the inner side of the panel member with each clip member being movable from a respective first position spaced from a corresponding edge section of the panel member to a second position closer to this corresponding edge section. The clip members are adapted to engage the structure within the aperture during use of the access panel. A spring arrangement biases the clip members towards their respective second positions and yieldably holds the clip members in these second positions. When the access panel is mounted on the structure, the access panel can be removed from the aperture by pulling the panel member in a direction away from the aperture and thereby causing at least one of the clip members to move inwardly towards its respective first position against the biasing force of the spring arrangement.

In a preferred embodiment, the aforementioned corresponding edge sections are opposite edge sections of the panel member and the movement of each clip member is guided by a guide track formed in or on the panel member.

Further features and advantages will be apparent from the following detailed description taken in conjunction with the accompanying drawings.

DETAILED DESCRIPTION OF PREFERRED EMBODIMENTS

Figure 1:
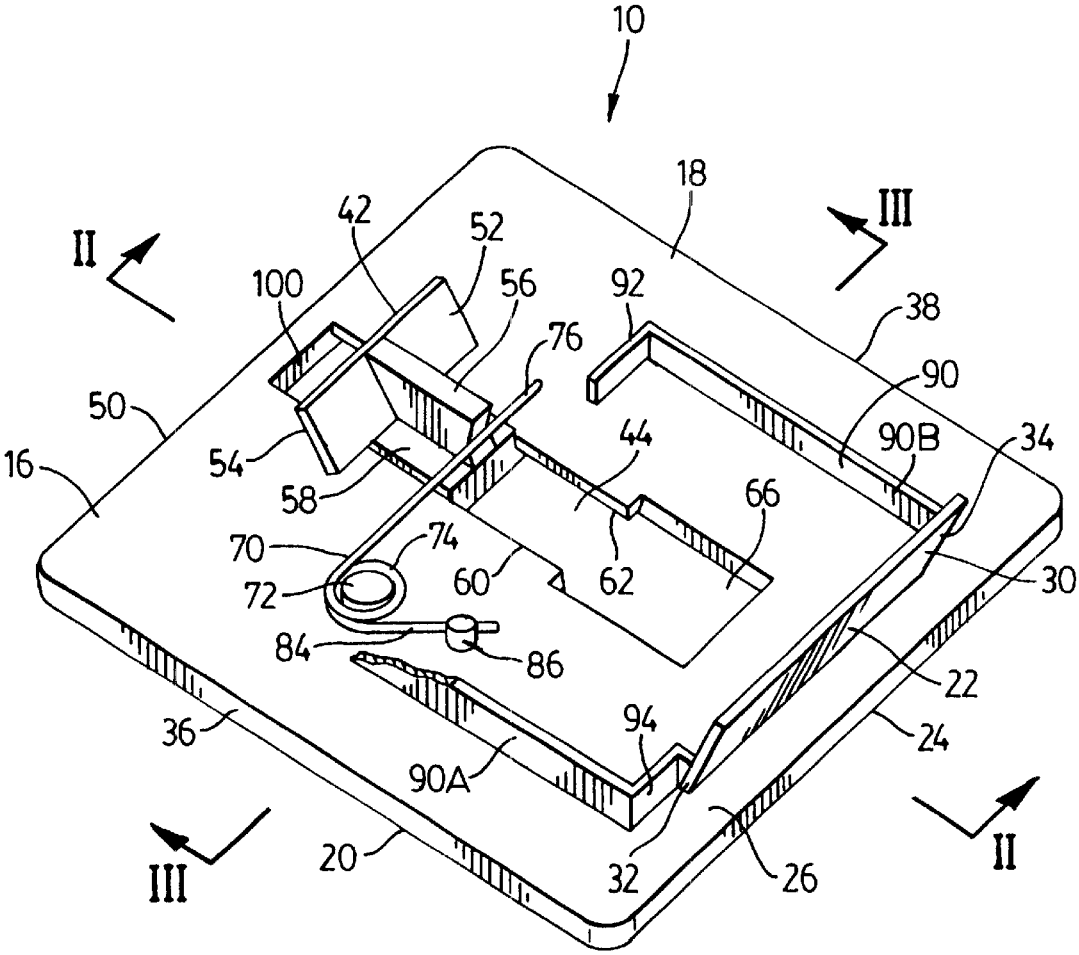
FIG. 1 is a perspective view showing the inner side of an access panel constructed in accordance with the invention.
Figure 2:
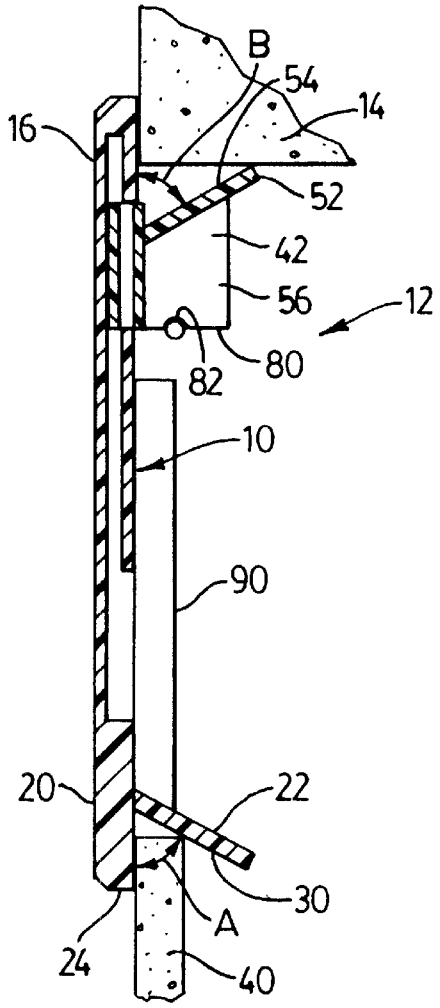
FIG. 2 is a cross sectional view of the access panel of FIG. 1 taken along the line II—II and showing this access panel mounted in an aperture of a structure.
Figure 3:
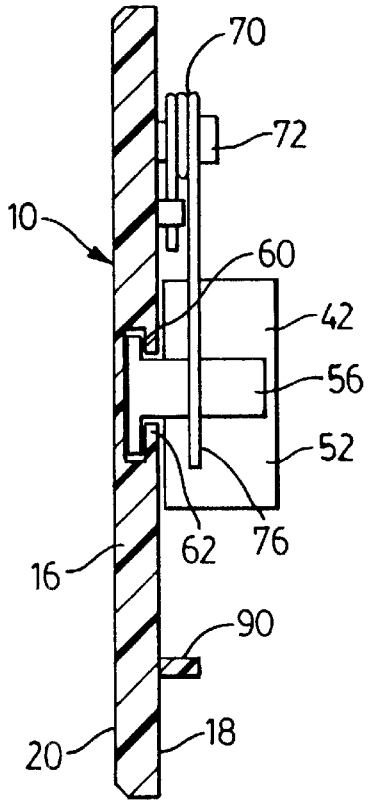
FIG. 3 is another cross sectional view of the access panel of FIG. 1, this view being taken along the line III—III of FIG. 1.

A preferred embodiment of an access panel 10 constructed in accordance with the invention is shown in FIGS. 1 to 3. It will be understood that this access panel is capable of covering an aperture, such as the aperture 12 illustrated in FIG. 2, in a structure such as a building wall 14 or a building ceiling. This access panel comprises a substantially planar panel member 16 having an inner side 18 and an outer side 20. As shown in FIG. 2, the panel is of sufficient size to cover the aperture 12. The illustrated panel member is square or rectangular with rounded corners but other shapes are possible, for example circular or elliptical. Generally speaking, the panel member can be shaped to correspond substantially to the shape of the aperture 12, if desired.

A mounting member 22 has an inner edge rigidly attached to the panel member 16 adjacent a first edge 24 thereof. This mounting member extends rearwardly from the inner side 18 of the panel member and is arranged to engage the structure within the aperture 12 during use of the access panel as illustrated in FIG. 2. The illustrated mounting member of the panel 10 is an elongate flange rigidly attached to the panel member and extending substantially parallel to the first edge 24. Preferably the inner edge of the flange or mounting member 22 is spaced a relatively short distance from the first edge as shown. In this way there is an edge portion 26 between the flange and the edge 24 which can engage the outer surface of the wall or ceiling. The preferred flange or mounting member 22 has an outer surface 30 facing towards the first edge 24 and sloping at an acute angle indicated at A in FIG. 2 relative to the inner side of the panel member 16. Also note that the opposite ends 32, 34 of the flange are spaced from the side edges 36, 38 respectively, thus allowing the access panel to be mounted in a rectangular or square aperture that may vary in its size to some extent.

It will be understood that because of the slope of the outer surface of the flange, the flange is capable of engaging an inner edge of a wall panel or ceiling panel as illustrated in FIG. 2. A relatively thin panel is indicated at 40 at the bottom of FIG. 2. At the same time the front surface of the wall panel is engaged by the inner side of the panel member 16. If the flange is made sufficiently wide as shown, it can accommodate wall paneling of various thicknesses while still adequately engaging and holding the access panel along one side edge.

The access panel 10 also has a clip member indicated generally by 42, this clip member being slidably mounted on the panel member 16 and guided in its movements by a guide track 44. The clip member extends or projects rearwardly from the inner side 18 as shown and is linearly movable in a direction parallel to the planar panel member or parallel to the inner side 18 thereof It should be understood that the clip member is movable from a first position as shown in FIG. 1 to a second position closer to and adjacent a second edge 50. In the first position the clip member is spaced from the second edge 50 of the panel member, the amount by which it is moved away from this second edge depending to some extent on the size of the aperture 12 in the wall or ceiling. The clip member 42 is adapted to engage the structure, for example the building wall 14 illustrated at the top of FIG. 2, within the aperture 12 during use of the access panel. The illustrated preferred clip member 42 has a transversely extending engagement section 52 which can be planar as shown and is preferably midway between the opposite edges 36, 38 of the panel. On the engagement section 52 is an outer surface 54 which faces towards the second edge 50 and that slopes at an acute angle relative to the inner side 18 of the panel. This acute angle is indicated at B in FIG. 2. Because of the slope of the engagement section 52, the clip member is better able to grip or engage the building wall 14 and it is also able to grip or engage a wall panel or ceiling panel in a manner similar to the mounting member 22 (as shown in FIG. 2). Extending from one side of the engagement section 52 is a centrally located support section 56 which also extends substantially parallel to the guide track 44. The preferred clip member also includes a slider section 58 that is sized to fit snugly between opposite longitudinal sides of the guide track 44. This slider section can be integrally connected to the support section 56 and the entire clip member 42 can be made of molded plastic or metal.

The guide track 44 is preferably an elongate, shallow recess formed in the inner side of the access panel. The illustrated preferred guide track includes two opposing guide flanges 60, 62 which extend along opposite sides of the recess and which slidably engage the slider section 58 of the clip member so as to retain the slider section in the recess. In order to allow the slider section 58 to be inserted into the recess, the flanges extend only part way along the recess and there are no flanges in the section of the recess indicated at 66. The length of the section 66 can be made about the same length as or longer than the slider section. The width of the section 66 corresponds closely to the width of the slider section. After the slider section is inserted into the section 66 of the recess, it can be slid towards the edge 50 so as to be captured by the two flanges 60, 62 and thereby held in the recess.

A spring mechanism indicated generally at 70 is provided to bias the clip member 42 towards the edge 50 and thus into engagement with the building wall 14 as shown in FIG. 2. The spring mechanism is thus able to yieldably hold the clip member 42 in its second or engagement position when the access panel is mounted on the structure and covers the aperture 12. The preferred illustrated spring mechanism includes a bent wire spring mounted on a boss 72 integrally formed on the inner side of the panel member 16. The illustrated spring is bent in a central section so as to form a spring loop 74 that extends completely around the boss 72. A straight end section of the spring indicated at 76 engages and presses against the clip member 42. Preferably one end 80 of the support section 56 is formed with a spring accommodating groove 82. Another end section 84 of the spring presses against a spring stop 86 that can be integrally formed on the inner side of the panel. The illustrated stop is in the form of a cylindrical protuberance.

The preferred illustrated access panel also has stiffening flanges 90 formed on the panel member 16 and projecting from the inner side 18. As illustrated in FIG. 1, there are two elongate flanges 90A and 90B which extend parallel to a longitudinal central axis of the guide track 44. In FIG. 1 the flange 90A is partially broken away for purposes of illustration. If desired, there can also be short end flanges indicated at 92 and 94 which can be integrally connected to ends of the flanges 90. The short flanges 94 can be integrally connected to the mounting member 22 to provide support for the member 22. It will be understood that these flanges can also assist in locating the access panel correctly over the aperture 12. They can help prevent the access panel from sliding or moving to a position where the aperture 12 is partially uncovered. The flanges 90 can also be used to outline the minimum size of the aperture 12 in which the access panel can be installed.

Preferably the wider section 66 of the recess in the panel is located at the inner end of the recess i.e. being closer to the center of the panel. Also preferably the recess and the guide flanges 60, 62 extend to an end 100 which is relatively close to the second edge 50, enabling the best performance and operation of the clip member. The preferred form of guide track is that illustrated in FIG. 1 with the guide flanges 60, 62 flush with the inner surface of the panel member. It is of course possible to have other forms of guide tracks instead of the illustrated recessed track. For example, it is possible for the track to be in the form of an elongate track strip that projects from the inner side 18. This strip can have a T-shaped cross section or a dovetail cross section, for example. The track can extend along a groove or elongate recess formed in the clip member which can extend around the track member so as to slidably hold the clip member on the track.

If desired, stop devices or other mechanisms can be provided on the panel member to ensure that the clip member does not become disengaged from the guide track. For example, a stop block (not shown) could be secured in the section 66 of the recess after the clip member has been installed to prevent the clip member from exiting through the section 66. Alternatively, an additional stop, similar to the spring stop 86 can be provided to stop the spring 70 from moving to such an extent so as to permit the clip member to enter the section 66 after the clip member has been installed.

Figure 4:
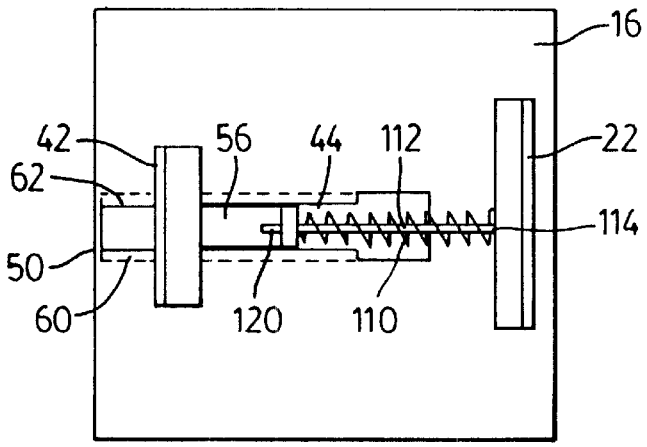
FIG. 4 is an inner side view of another embodiment of an access panel constructed in accordance with the invention, this embodiment incorporating a compression spring.

Turning now to the embodiment illustrated in FIG. 4, this embodiment can be made similar in its construction to the first embodiment of FIGS. 1 to 3 except for the differences noted hereinafter. The second embodiment of FIG. 4 also has a panel member 16 which can be rectangular or square. This embodiment also has a fixed mounting member 22 which can be in a form of an elongate flange that slopes at an acuate angle to the inner side of the panel. Formed on the inner side of the panel is a guide track 44 which is in the form of an elongate, shallow recess. A sliding clip member 42 is mounted in the guide track. The primary difference between this embodiment of the access panel and the first embodiment is the use of a coil-type compression spring 110 which preferably extends around an elongate mounting rod 112 that extends parallel to the longitudinal central axis of the guide track 44. One end 114 of the rod can be rigidly mounted in the mounting member 22 or in a separate support bracket located on the inner side of the mounting member 22 and thus one end of the coil spring presses against either the inner side of the mounting member 22 or the support bracket. The opposite end of the coil spring presses against the inner end of the support section 56 of the clip member. An end section 120 of the mounting rod 112 is slidably mounted in the support section 56 in a suitable hole formed in the section. It will thus be seen that the spring 110 biases the clip member towards the edge 50 of the panel.

Figure 5:
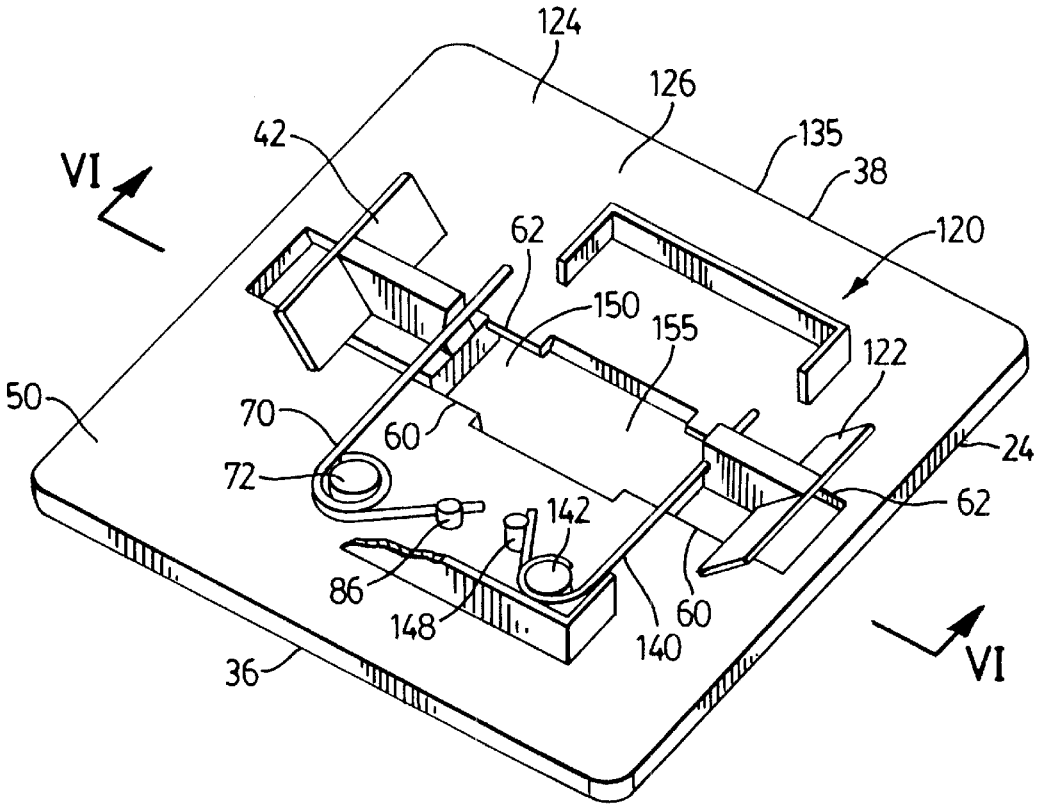
FIG. 5 is a perspective view of yet another embodiment of the access panel, this view showing the inner side of the panel.
Figure 6:
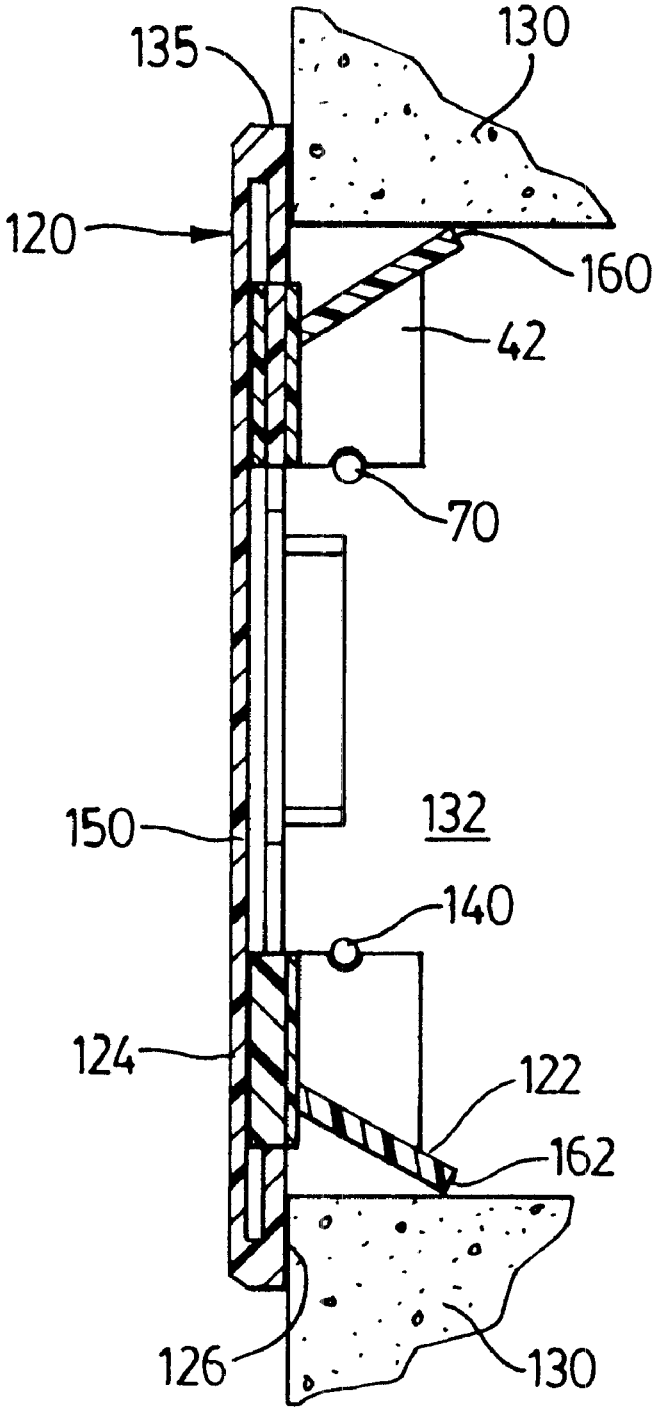
FIG. 6 is a cross sectional view of the access panel of FIG. 5, this view being taken along the line VI—VI of FIG. 5.

Turning now to a further possible embodiment of the access panel of the invention, this third embodiment is indicated generally at 120 in FIGS. 5 and 6. This embodiment is similar to the access panel 10 except for the differences noted hereinafter. In this embodiment there are two movable clip members 42 and 122 mounted on the panel member 124 and projecting rearwardly from an inner side 126 thereof Both of these clip members are linearly movable in a direction parallel to the inner side 126 of the panel member and each clip member is movable from a respective first position (for example the position of the clip member 42 shown in FIG. 5) to a second position closer to the corresponding edge section. The two clip members are adapted to engage the structure, for example the brick or stone wall 130 shown in FIG. 6 within the aperture 132 during use of the access panel. It will be understood that the illustrated square or rectangular panel member 124 has a peripheral edge 135 extending about its perimeter and this peripheral edge can be considered as having four edge sections including edge sections 24, 36, 38 and 50. Thus the clip member 42 in a respective first position is spaced from its corresponding edge section 50 while the clip member 122 in its first position is spaced from its corresponding edge section 24. In the second position the clip member 42 is closer to the edge section 50 while the clip member 122 is closer to the edge section 24.

As in the first embodiment there is a spring arrangement for biasing the two clip members 42, 122 towards their respective second positions and for yieldably holding these clip members in the second positions. As illustrated each clip member is biased by means of its own bent spring 70 and 140. The bent spring 70 is the same as that used in the first embodiment as is the bent spring 140. Each bent spring is mounted on a respective boss 72, 142 which can be integrally formed on the inner side of the panel member. Also each bent spring can be provided with its own spring stop 86, 148 which engages one end of the spring. Each of these stops acts to preload its respective bent spring so that the spring biases its clip member towards its corresponding edge section.

In the access panel of FIG. 5, there is a longer guide track 150 in the form of a shallow recess. The guide track is made longer than in the embodiment of FIG. 1 so as to accommodate the two clip members. There are inwardly extending guide flanges 60, 62 at each end of the guide track. Formed in the centre of the guide track is a section 155 wherein there are no guide flanges 60, 62 so as to permit each of the clip members to be installed in the guide track.

It will be appreciated that the access panels of the present invention are constructed so that they can be successfully installed in an aperture or opening in a brick or concrete wall as illustrated in FIG. 6. The clip members 42, 122 are formed with projecting engagement edges 160, 162 which enable these clip members to satisfactory grip the rough surface which is often encountered in an opening formed in a concrete or brick wall.

The access panel of this invention can be installed in a range of apertures of varying size by placing the or one of the spring loaded clip members (42, 122) on one edge of the aperture first, and then sliding the access panel at a slight angle to the surface of the wall or ceiling in the direction of the spring loaded clip member. At the point where the fixed mounting member 22 or the other movable clip member is in a position to clear the opposite edge of the aperture, the panel can then be fully inserted into the aperture by a pivoting motion. The single spring or the spring arrangement causes the two clip members or the single clip member and the mounting member to be pressed against the opposite sides of the aperture and results in a firm and fast installation of the access panel.

It will be seen that one of the advantages of the present access panel is that it does not require special framing to be installed around or in the aperture in order to mount the access panel in place. Furthermore the access panel of the invention can be removed from the aperture each time this is required simply by grasping the side edges of the access panel and pulling the panel away from the aperture. As a result of this action, the spring permits the movable clip member or clip members to move inwardly, thus freeing the access panel.

It will be appreciated by those skilled in the art that various modifications and changes can be made to the described access panels without departing from the spirit and scope of this invention. Accordingly, all such modifications and variations as fall within the scope of the appended claims are intended to be included in this invention.

What is claimed is:

1. An access panel for covering an aperture in a structure, said panel comprising a substantially planar panel member having inner and outer sides and of sufficient size to cover said aperture;

a mounting member having an inner edge rigidly attached to said panel member adjacent a first edge of the panel member and extending rearwardly from said inner side of said panel member, said mounting member being arranged to engage said structure within said aperture during use of said access panel;

a movable clip member mounted on said panel member and extending rearwardly from said inner side of said panel member, said clip member being linearly movable in a direction parallel to said panel member from a first position spaced from a second edge of said panel member, which is opposite said first edge, to a second position closer to said second edge, said clip member being adapted to engage said structure within said aperture during use of said access panel; and a spring mechanism for biasing said clip member towards said second position and for yieldably holding said clip member in said second position when said access panel is mounted on said structure and covers said aperture, wherein, when said access panel is mounted on said structure so as to cover said aperture, said access panel can be removed from said aperture by pulling the panel member in a direction away from said aperture and thereby causing said clip member to move inwardly towards said first position against the biasing force of said spring mechanism.

2. An access panel according to claim 1 wherein said panel member has a guide track formed therein and open on said inner side and said clip member is mounted for sliding movement along said guide track.

3. An access panel according to claim 2 wherein said mounting member is an elongate flange attached to said panel member, extending substantially parallel to said first edge, and having its inner edge spaced a relatively short distance from said first edge.

4. An access panel for covering an aperture in a structure, said panel comprising:

a substantially planar panel member having inner and outer sides and of sufficient size to cover said aperture, said panel member having a guide track formed therein and open on said inner side;

a mounting member rigidly attached to said panel member adjacent to but spaced a relatively short distance from a first edge of the panel member and extending rearwardly from said inner side of said panel member, said mounting member being an elongate flange extending substantially parallel to said first edge, said flange having an outer surface facing towards said first edge and sloping at an acute angle relative to said inner side of said panel member, said flange being adapted to engage said structure within said aperture during use of said access panel;

a movable clip member mounted on said panel member for sliding movement along said guide track and extending rearwardly from said inner side of said panel member, said clip member being linearly movable in a direction parallel to said panel member from a first position spaced from a second edge of said panel member, which is opposite said first edge, to a second position closer to said second edge, said clip member being adapted to engage said structure within said aperture during use of said access panel; and a spring mechanism for biasing said clip member towards said second position and for yieldably holding said clip member in said second position when said access panel is mounted on said structure and covers said aperture.

5. An access panel member according to claim 4 wherein said clip member has an outer surface that faces towards said second edge and that slopes at an acute angle relative to said inner side of said panel member.

6. An access panel according to claim 3 including at least two stiffening flanges formed on said panel member and projecting from said inner side, said stiffening flanges extending parallel to a longitudinal, central axis of said guide track.

7. An access panel according to claim 2 wherein said guide track is formed within the panel member so as not to project from said inner side and said clip member includes a slider section sized to fit snugly between opposite longitudinal sides of said guide track.

8. An access panel according to claim 2 wherein said spring mechanism includes a bent wire spring mounted on a boss formed on said inner side of said panel member and said bent wire spring has one end thereof engaging and pressing against said clip member.

9. An access panel according to claim 2 wherein said spring mechanism includes a coil-type compression spring extending around an elongate mounting rod connected to said panel member.

10. An access panel for covering an aperture in a structure, said panel comprising:

a panel member having inner and outer sides, a peripheral edge extending around its perimeter, and a guide track provided on said inner side;

a mounting member having an inner edge rigidly attached to said panel member and projecting rearwardly from said inner side of the panel member so as to engage said structure within said aperture during use of said access panel;

a clip member slidably mounted on said panel member and guided in its movement by said guide track, said clip member being slidable in a direction parallel to said inner side of said panel member from a first position spaced from a portion of said peripheral edge to a second position closer to said portion of said peripheral edge, said clip member being adapted to engage said structure within said aperture during use of said access panel; and a spring mechanism for biasing said clip member towards said second position and for yieldably holding said clip member in said second position, wherein, when said access panel is mounted on said structure so as to cover said aperture, said access panel can be removed from said aperture by pulling the panel member in a direction away from said aperture and thereby causing said clip member to move inwardly towards said first position against the biasing force of said spring mechanism.

11. An access panel according to claim 10 wherein said mounting member is an elongate flange attached to said panel member on said inner side and its inner edge is spaced from an adjacent portion of said peripheral edge.

12. An access panel according to claim 10 wherein said guide track comprises an elongate, shallow recess formed in said access panel.

13. An access panel according to claim 12 wherein said guide track includes two opposing guide flanges extending along opposite sides of said recess and slidably engaging a slider section of said clip member so as to retain said slider section in said recess.

14. An access panel according to claim 13 wherein said spring mechanism includes a bent wire spring mounted on a boss formed on said inner side of said panel member and one end of said spring engages and presses against said clip member.

15. An access panel for covering an aperture in a structure, said panel comprising:

a panel member having inner and outer sides and dimensioned so as to at least substantially cover said aperture during use thereof;

two movable clip members mounted on said panel member and projecting rearwardly from said inner side, said clip members being linearly movable in a direction parallel to said inner side of the panel member with each clip member being movable from a respective first position spaced from a corresponding edge section of said panel member to a second position closer to said corresponding edge section, said clip members being adapted to engage said structure within said aperture during use of said access panel; and a spring arrangement for biasing said clip members towards their respective second positions and for yieldably holding said clip members in said second positions, wherein, when said access panel is mounted on said structure so as to cover said aperture, said access panel can be removed from said aperture by pulling the panel member in a direction away from said aperture and thereby causing at least one of said clip members to move inwardly towards its respective first position against the biasing force of said spring arrangement.

16. An access panel according to claim 15 wherein the two corresponding edge sections are opposite edge sections of said panel member and the movement of each clip member is guided by a guide track formed in or on said panel member.

17. An access panel for covering an aperture in a structure, said panel comprising:

a panel member having inner and outer sides and dimensioned so as to at least substantially cover said aperture during use thereof, at least one guide track being formed in or on said panel member;

two movable clip members mounted on said panel member and projecting rearwardly from said inner side, said clip members being linearly movable in a direction parallel to said inner side of the panel member and guided by said at least one guide track with each clip being movable from a respective first position spaced from a corresponding edge section of said panel member to a second position closer to said corresponding edge section, said clip members being adapted to engage said structure within said aperture during use of said access panel, each clip member having an outer surface that faces towards its corresponding edge section and slopes at an acute angle relative to said inner surface of said panel member; and a spring arrangement for biasing said clip members towards their respective second positions and for yieldably holding said clip members in said second positions, wherein the two corresponding edge sections are opposite edge sections of said panel member.

18. An access panel according to claim 16 wherein said guide track is an elongate shallow recess formed in said panel member.

19. An access panel according to claim 18 wherein said guide track includes at least two opposing guide flanges extending along opposite sides of said recess and slidably engaging a slider section of each clip member so as to retain said slider section in said recess.

* * * * *